US006708738B2

(12) United States Patent
Olsen

(10) Patent No.: US 6,708,738 B2
(45) Date of Patent: Mar. 23, 2004

(54) SELF FUNNELLING DRINK ADDITIVE PRODUCT

(76) Inventor: Carol Olsen, 21 E. 363 Walnut Rd., Glenn Ellen, IL (US) 60137

( * ) Notice: Subject to any disclaimer, the term of this patent is extended or adjusted under 35 U.S.C. 154(b) by 7 days.

(21) Appl. No.: 10/238,235

(22) Filed: Sep. 10, 2002

(65) Prior Publication Data

US 2003/0005975 A1 Jan. 9, 2003

Related U.S. Application Data

(63) Continuation-in-part of application No. 09/681,059, filed on Dec. 14, 2000, now abandoned.

(51) Int. Cl.[7] ..... B65B 3/16

(52) U.S. Cl. ..... 141/114; 141/363; 141/364; 141/365; 141/366; 383/200; 383/207; 383/209

(58) Field of Search ..... 141/2, 18, 114, 141/319, 331, 337, 363–366; 215/47–49; 206/222; 220/265, 266; 383/200–210

(56) References Cited

U.S. PATENT DOCUMENTS

| | | | | |
|---|---|---|---|---|
| 1,182,449 A | | 5/1916 | Booth | |
| 1,438,487 A | | 12/1922 | Greene | |
| 2,248,226 A | | 7/1941 | Abrams | |
| 2,688,914 A | | 9/1954 | Eckler | |
| 2,952,394 A | | 9/1960 | Scheneider | |
| 3,112,047 A | | 11/1963 | Weinrich et al. | |
| 3,125,258 A | | 3/1964 | Watts | |
| 3,275,448 A | | 9/1966 | Sommer | |
| 3,278,085 A | | 10/1966 | Brown | |
| 3,601,252 A | | 8/1971 | Sager | |
| RE27,838 E | | 12/1973 | Leasure et al. | |
| 4,813,862 A | | 3/1989 | Bowers et al. | |
| 4,825,915 A | | 5/1989 | Hess | |
| 4,998,646 A | | 3/1991 | Sherman | |
| 5,378,065 A | * | 1/1995 | Tobolka | 383/9 |
| 5,497,913 A | | 3/1996 | Baker | |
| 5,826,737 A | * | 10/1998 | Zakensberg | 215/47 |

FOREIGN PATENT DOCUMENTS

| | | |
|---|---|---|
| JP | 401099904 A | 4/1989 |

* cited by examiner

*Primary Examiner*—Timothy L. Maust

(57) ABSTRACT

The self funnel drink additive product has two surfaces connected at a perimeter to enclose a volume which contains drink additive, the volume being substantially flat for storage, and has a narrow neck portion of the perimeter, so that the drink additive is funneled through the narrow neck into a vessel opening when the perimeter is opened along an optimal cut line at the narrow neck.

5 Claims, 1 Drawing Sheet

SELF FUNNELLING DRINK ADDITIVE PRODUCT

This is a continuation in part of co-pending U.S. patent application Ser. No. 09/681,059 filed Dec. 14, 2000, abandoned on Jan. 10, 2003.

The product for holding drink additive—which is substantially flat for storage, and has a narrow neck—when cut open at a predetermined optimal cut line, funnels drink additive into a narrow opening of a vessel.

Figure 1:
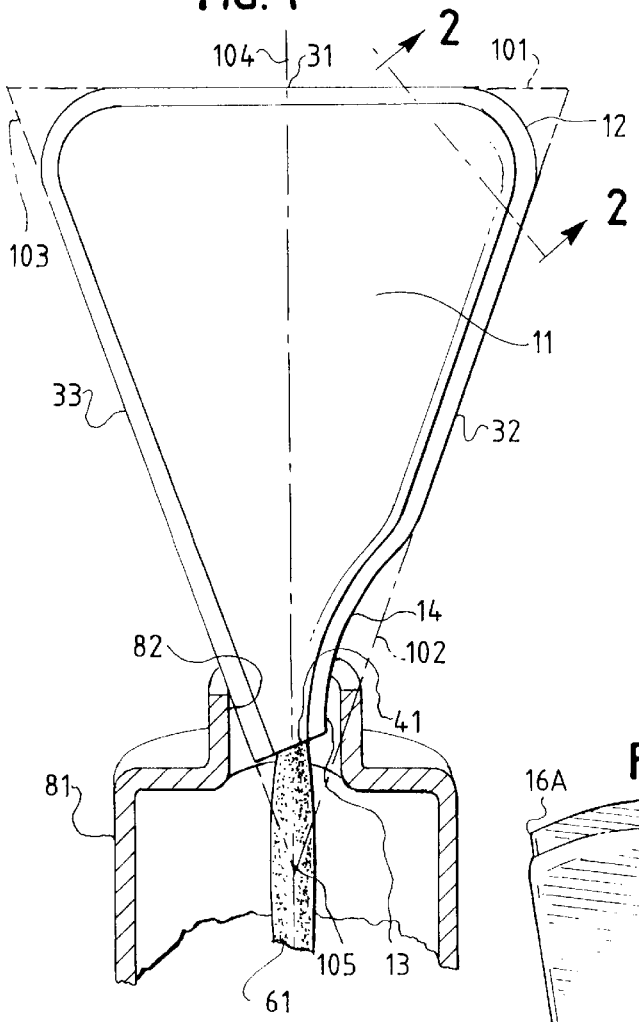
FIG. 1 shows the product in use.
Figure 2:
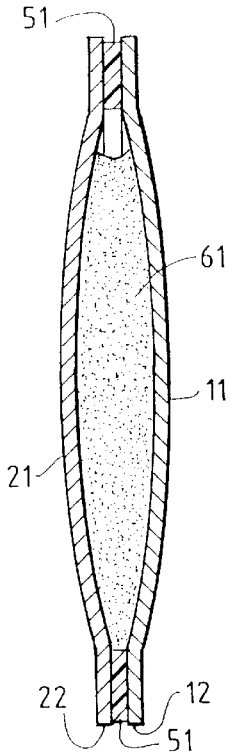
FIG. 2 is a view across line 2—2 in FIG. 1.

The self funnel drink additive pack product is used with drink additive 61 and with a vessel 81 having a vessel opening 82. The product comprises a first surface 11, 11A having a perimeter 12, 12A, a second surface 21 connected to the first surface along the perimeter 22, 22A and a narrow neck 13, 13A portion of the perimeter.

The narrow neck makes the product a funnel when the perimeter is cut open across the narrow neck as depicted in FIG. 1. Drink additive 61 is funneled through the narrow neck 13, 13A into the vessel opening 82 when the perimeter is opened at cut 41, 41A at the narrow neck and the narrow neck is at the vessel opening.

Figure 3:
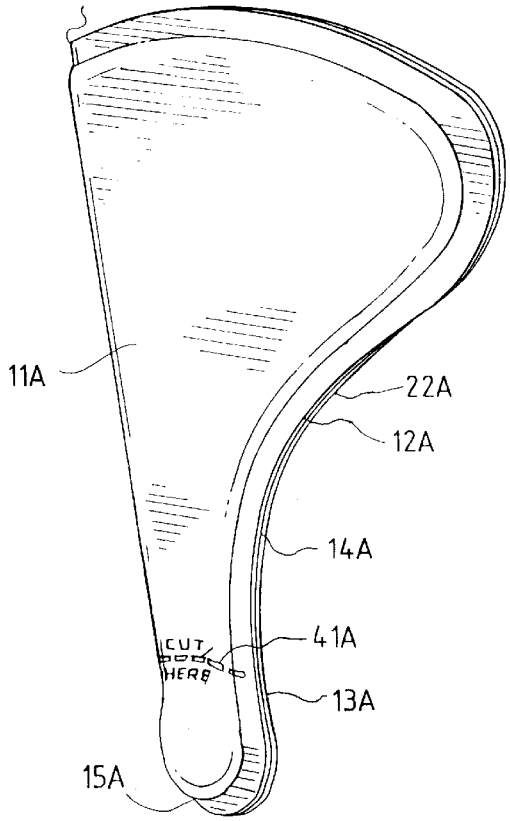
FIG. 3 shows another form of the product.

The first surface and the second surface enclose a volume which contains the drink additive. The first surface and the second surface can be connected by a sealant 51. The first surface and the second surface can be contiguous along one portion of the perimeter—from 15A to 16A in FIG. 3 for example—and sealed along the remainder of the perimeter.

The volume is substantially flat for storage. "Substantially flat" means that separation between the first surface and the second surface is caused only by the additive and not by any structural properties of the product.

The perimeter has negative curvature 14, 14A proximal the narrow neck so that the narrow neck can fit in a smallest periphery of the vessel opening 82 with the product oriented tangent to a funneling triangle. The funneling triangle is defined by a first side 101 perpendicular to a central axis 104 centered on the smallest periphery of the vessel opening, a first vertex 105 within the vessel opening, a second side 102 connecting the first vertex to the first side, and a third side 103 connecting the first vertex to the first side. The funneling triangle is tangent to the perimeter at least at one first side point 31, at least at one second side point 32, and at least at one third side point 33.

Slip-stick granule motion dynamics provide that granules will flow easily when the product is oriented this way. Also, since all of the drink additive can flow easily in this orientation, there is no need for the orientation to be changed.

Since the geometry and the dynamics provided by the narrow neck make it easy to funnel drink additive into vessels with narrow openings, these vessels will be reused to make flavored drinks by adding drink flavoring to water in the vessel instead of being discarded and replaced by a new vessel pre-filled with a flavored drink. A great reduction in discarded flavored drink vessel waste results.

Similar results obtain when the drink additive is liquid. The drink additive can be any thing which can be added to a drink, such as flavorings, nutrients, and medicines.

The location of the cut line which will allow the best flow of drink additive depends on specific geometric and physical properties such as the funneling triangle, the curvature, the narrow neck, the drink additive granule size, granule—granule interactions, and granule-surface interactions. For a given set of specific geometric and physical properties, a preferred cut line can be predetermined and a mark 41, 41A can be provided on the product to show the location of this preferred cut line.

What is claimed is:

1. A self funnel drink additive product used with drink additive and with a vessel having a vessel opening, the product comprising:

a first surface having a perimeter;

a second surface connected to the first surface along the perimeter to enclose a volume which contains the drink additive, the volume being substantially flat for storage; and a narrow neck portion of the perimeter, the perimeter having negative curvature proximal the narrow neck so that the narrow neck can fit within a smallest periphery of the vessel opening with the product oriented tangent to a funneling triangle, the funneling triangle being defined by a first side perpendicular to a central axis centered on the smallest periphery of the vessel opening, a first vertex within the vessel, a second side connecting the first vertex to the first side, and a third side connecting the first vertex to the first side, the funneling triangle being tangent to the perimeter at least at one first side point, at least at one second side point, and at least at one third side point.

2. The product of claim 1 wherein the second surface is connected to the first surface by being sealed at the perimeter.

3. The product of claim 1 wherein the second surface is contiguous with the first surface along a contiguous portion of the perimeter and is sealed to the first surface along the remainder of the perimeter.

4. The product of claim 1 wherein there is a mark on the first surface indicating a preferred cut line, the mark being predetermined from specific geometric and physical properties.

5. A self funnel drink additive product used with drink additive and with a vessel having a vessel opening, the product comprising:

a first surface having a perimeter;

a second surface connected to the first surface along the perimeter to enclose a volume which contains the drink additive, the volume being substantially flat for storage;

a narrow neck portion of the perimeter, the perimeter having negative curvature proximal the narrow neck so that the narrow neck can fit within a smallest periphery of the vessel opening with the product oriented tangent to a funneling triangle, the funneling triangle being defined by a first side perpendicular to a central axis centered on the smallest periphery of the vessel opening, a first vertex within the vessel, a second side connecting the first vertex to the first side, and a third side connecting the first vertex to the first side, the funneling triangle being tangent to the perimeter at least at one first side point, at least at one second side point, and at least at one third side point; and a mark on the first surface indicating a preferred cut line, the mark being predetermined from specific geometric and physical properties.

* * * * *